US009531093B2

(12) United States Patent
Gleisberg

(10) Patent No.: US 9,531,093 B2
(45) Date of Patent: Dec. 27, 2016

(54) ELECTRICAL CONNECTION ARRANGEMENT

(71) Applicant: FEW Fahrzeugelektrikwerk GmbH & Co. KG, Zwenkau (DE)

(72) Inventor: Roy Gleisberg, Markranstaedt (DE)

(73) Assignee: FEW FAHRZEUGELEKTRIKWERK GmbH & CO.KG, Zwenkau (DE)

( * ) Notice: Subject to any disclaimer, the term of this patent is extended or adjusted under 35 U.S.C. 154(b) by 0 days.

(21) Appl. No.: 14/900,744

(22) PCT Filed: Jun. 17, 2014

(86) PCT No.: PCT/EP2014/062698

§ 371 (c)(1),
(2) Date: Dec. 22, 2015

(87) PCT Pub. No.: WO2014/206813

PCT Pub. Date: Dec. 31, 2014

(65) Prior Publication Data

US 2016/0141777 A1 May 19, 2016

(30) Foreign Application Priority Data

Jun. 24, 2013 (DE) ..... 20 2013 005 678
Sep. 13, 2013 (DE) ..... 20 2013 008 144

(51) Int. Cl.
*H01R 4/04* (2006.01)
*H01R 12/63* (2011.01)
(Continued)

(52) U.S. Cl.
CPC ..... *H01R 12/63* (2013.01); *H01R 4/02* (2013.01); *H01R 4/70* (2013.01); *H01R 4/021* (2013.01); *H01R 4/04* (2013.01); *H01R 13/405* (2013.01)

(58) Field of Classification Search
USPC ..... 174/252, 84 R
See application file for complete search history.

(56) References Cited

U.S. PATENT DOCUMENTS 4,667,401 A * 5/1987 Clements ..... H01R 4/04 252/511
4,868,637 A * 9/1989 Clements ..... H01R 4/04 174/88 R (Continued)

FOREIGN PATENT DOCUMENTS

DE 10 2010 051 670 5/2012
EP 0 542 005 5/1993

(Continued)

OTHER PUBLICATIONS

International Search Report Issued Aug. 19, 2014 in PCT/EP14/062698 Filed Jun. 17, 2014.

*Primary Examiner* — William H Mayo, III
*Assistant Examiner* — Krystal Robinson
(74) *Attorney, Agent, or Firm* — Oblon, McClelland, Maier & Neustadt, L.L.P.

(57) ABSTRACT

An electrical connection arrangement is provided between at least one flat conductor or conductor portion and a cable, the flat conductor or conductor portion leading to a pane, and electric or electronic components situated there, and the cable being an integral part of an external connection. The flat conductor or conductor portion is formed on a carrier film, and has an encapsulation as a plastic injection overmolding in the area of the electric contacting point of cable and flat conductor or conductor portion. An adhesion-promoting, heat-activated adhesive film is applied in the area of the carrier film while leaving the space for the electrical contacting point, yet surrounding or two-dimensionally delimiting same.

7 Claims, 2 Drawing Sheets

Figure 1:
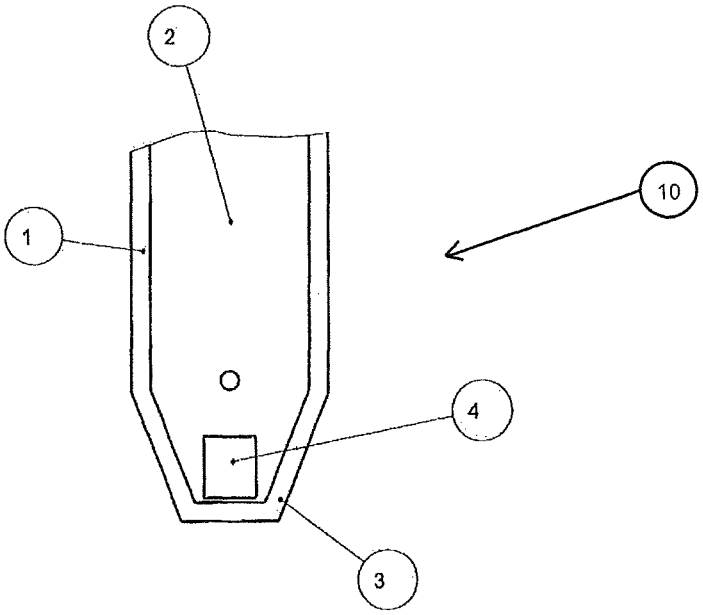

(51) Int. Cl.

| | |
|---|---|
| ***H01R 4/02*** | (2006.01) |
| ***H01R 4/70*** | (2006.01) |
| *H01R 13/405* | (2006.01) |

(56) References Cited

U.S. PATENT DOCUMENTS

| | | | | |
|---|---|---|---|---|
| 5,231,758 | A | 8/1993 | Schauer | |
| 5,724,730 | A * | 3/1998 | Tanaka | B29C 45/14639 174/76 |
| 2003/0090007 | A1* | 5/2003 | Fischbach | H01L 21/563 257/789 |
| 2004/0060171 | A1* | 4/2004 | Edwardsen | H01R 43/205 29/747 |
| 2004/0182599 | A1* | 9/2004 | Nguyen | H01R 43/24 174/138 D |
| 2012/0325552 | A1* | 12/2012 | Sakura | H01R 4/185 174/74 R |
| 2013/0269990 | A1 | 10/2013 | Jenrich et al. | |

FOREIGN PATENT DOCUMENTS

| | | | |
|---|---|---|---|
| EP | 1 443 604 | 8/2004 | |
| EP | 1 619 759 | 1/2006 | |
| EP | 1619759 A1 * | 1/2006 | H01R 4/022 |
| EP | 2 309 604 | 4/2011 | |

* cited by examiner

ELECTRICAL CONNECTION ARRANGEMENT

BACKGROUND OF THE INVENTION

The invention relates to an electrical connection arrangement between at least one flat conductor or conductor portion and a cable, the flat conductor or conductor portion leading to a pane, optionally laminated pane, and electric or electronic components situated there, and the cable being an integral part of an external connection, wherein the flat conductor or conductor portion is further formed on a carrier film, optionally polyimide film, and having an encapsulation as a plastic injection overmolding at least in the area of the electric contacting point of cable and flat conductor or conductor portion, according to the preamble of claim 1.

Electrical line connections according to the features of the preamble of claim 1 are part of the state of the art. Such line connections include, for instance, a transition from a flat strip connector to an electric cable. Such line connections are used, for example, in laminated panes which are employed in vehicles. Laminated panes are composed of two rigid glass panes and an adhesive film or adhesive layer bonding them adhesively. Electrical components, e.g. in the form of antenna conductors, heating conductors or the like may be introduced into such laminated panes. The line connections mentioned above are necessary for connecting these electrical components.

Regarding the connection of the interior space of the panes' composite construction to the exterior space, flat cables may be used, which are composed of a carrier film having a metallic coating. Such a laminate of two or more layers is sufficiently thin so as to be able to be inserted into the composite's interspace.

As to the external connection, such flat cables are usually connected, optionally soldered to the actual electrical connecting cable.

The joint is now required to be protected from humidity and other climatic influences so that safe operation of the connected electrical components can ensue.

In this respect, an electrical line connection having a cross-sectional transition as well as a method for producing such a connection is already known from EP 1 619 759 B1.

According to the teaching as per EP 1 619 759 B1 a statement was made that usual plastic protective bodies even with different configuration in shape and material do not enable the joint to be sufficiently protected when soldering. For this reason, the proceeding was to surround the actual electrical solder joint with a softer insulating and sealing compound. This also led to problems, in particular at higher temperature loads.

Furthermore, the teaching according to EP 1 619 759 B1 shows the option to cover or enclose only a small area in relation to the total width of the flat cable with a permanently elastic insulating compound. After the application of this preferably transparent insulating compound in a first process step, sufficient sealing against the ingress of liquid and moisture should be created excluding the occurrence of short-circuits and corrosion damage. Nevertheless, it was necessary to realize the protective body due to the mechanical and thermal loads during the second processing and also with respect to installing a corresponding pane including connecting elements in a vehicle body, since the insulating compound alone is not or only poorly resistant to mechanical or thermal load.

Correspondingly, the protective body is manufactured in a second step of the process by injecting a suitable plastic material at or around the connection area and the previously applied insulating compound. In the final state, the insulating compound is thus completely embedded within the protective body so that the risk of leakage is minimized. The outer contour of the insulating compound thus forms a common body or boundary surface with the protective body situated above.

In other words, the insulating and sealing compound to be applied having permanently elastic properties constitutes a pre-casting which is necessary to seal the connection's solder joint. This pre-casting forms a better cross-linking with the film-laminate arrangement and can ensure the desired protection of the solder joint even in alternating climatic loads. Since the pre-casting, however, is not suitable for use at higher temperatures a final casting needs to be injected around the latter so that the actual protective body is generated.

The skilled person will readily appreciate that the forming of a pre-casting for forming a permanently elastic insulating and sealing layer followed by a second casting for obtaining the protective body involves higher expenditures both in terms of material cost and in manufacturing which have to be avoided as far as possible.

From the aforementioned, it is therefore an object of the invention to propose an improved electrical connection arrangement and associated manufacturing method adapted to contact a flat conductor or conductor portion and a cable, the flat conductor or conductor portion leading to a pane, optionally laminated pane, and electric or electronic components situated there. The created connection arrangement should withstand all thermal and mechanical loads arising during subsequent machining and processing steps and guarantee an interference-free contact connection during later use, e.g. in a vehicle, and namely independent of thermal and/or climatic influences related to the respective conditions of use of the vehicle.

SUMMARY OF THE INVENTION

The inventive task is solved by an electrical connection arrangement according to the feature combination as per claim 1, the subclaims representing at least appropriate configurations and further developments. Further inventive is a technology resulting from claim 1 for manufacturing an associated connection arrangement.

Consequently, an electrical connection between at least one flat conductor or conductor portion and a cable is taken as a basis, the flat conductor or conductor portion leading to a pane, optionally a laminated pane, and electric or electronic components situated there.

The cable is an integral part of an electrical external connection and leads, for example, to a socket connector, a plug-in connection or other electric or electronic assemblies.

According to the state of the art, the flat connector or connector portion is situated on a carrier film, optionally a polyimide film, and may have a further, covering layer which is correspondingly exposed prior to establishing the electrical connection, e.g. by soldering.

The electrical connection arrangement furthermore comprises an encapsulation formed as a plastic injection overmolding, and namely at least in the area of the electric contacting point of cable and flat conductor or conductor portion. It is within the meaning of the invention that the plastic injection overmolding may also exhibit a larger spatial extension and moreover has means for attachment.

According to the invention, an adhesion-promoting, heat-activated adhesive film is firstly applied in the area of the carrier film while leaving the space 11 for the actual electrical contacting point, yet surrounding or two-dimensionally delimiting same, for realizing the electrical connection arrangement.

After the implementing of the electrical connection at the contacting point, e.g. by soldering, the preferably single plastic injection overmolding known per se is realized for forming a protective body. According to the invention, the temperature and pressure effect necessary in the plastic injection overmolding simultaneously activates the adhesive film so that a highly dense and durable bonding of the components cited above results.

The forming of a pre-casting in terms of an elastic or permanently elastic compound surrounding the contacting point may be omitted according to the invention.

By adapting the conditions relating to curing temperature and pressure ratios with respect to the adhesive film to the corresponding measures for the plastic injection overmolding, the technological sequence is simplified and work can be done using hitherto known equipment in use.

In a preferred embodiment, the adhesive film is formed as an adhesive foil. The adhesive agent, respectively the adhesive foil may here be slightly self-adhesive and, as mentioned above, cures under heat and pressure. In a particular embodiment, the adhesive foil may be made of a nonwoven material impregnated and/or coated with an adhesive agent. Furthermore, the adhesive foil may be provided with a so-called liner, i.e. a peelable cover, at least at one side.

This liner may at the same time virtually serve as a solder resist mask since the liner as well as the adhesive film according to the explanations above leave the contacting point itself free, but surround it at the sides, i.e. laterally.

According to the invention, the heat activation and curing temperature of the plastic film is thus adapted to the processing temperature of the plastic injection overmolding compound.

Furthermore, the pressure ratios set for forming the overmolding correspond at least to the contact pressure required for the adhesive film.

Due to the use of the adhesive film, a secure cross-linking between the carrier film and the overmolding is generated without requiring a pre-casting layer or permanently elastic insulating or sealing compound which constitutes an essential advantage as compared to the state of the art.

DETAILED DESCRIPTION OF THE INVENTION

The invention will be shown by means of an exemplary embodiment and with the help of FIGS. 1 to 4 which illustrate the fundamental technological process of manufacturing the electrical connection and formation of the required sealing.

Starting from the carrier film 1, the laminated flat conductor or conductor portion 10 exhibits an end 2 oriented toward the pane (not shown) as well as a contacting end 3 (FIG. 1).

In the area of the contacting end 3, a conductor portion is exposed forming the contact point 4 for connecting a cable 5.

In the following representation according to FIG. 2 which corresponds to the next technological step, the adhesive foil 6 is applied in a surface area which substantially corresponds to the formation of the later plastic injection overmolding 7.

Figure 2:
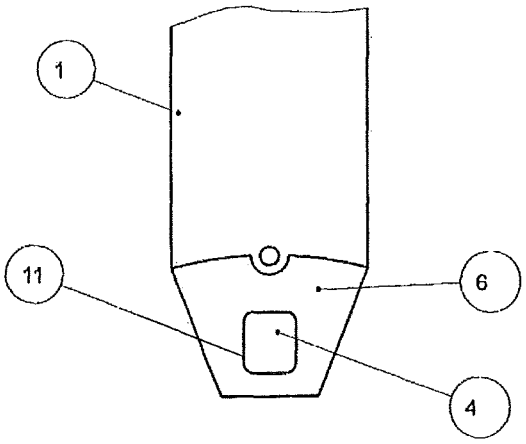

From FIG. 2 can be seen that the electric contacting point 4 is left exposed from the adhesive foil 6 but surrounds the contacting point 4 laterally. Alternatively, the adhesive foil 6 may delimit the contacting point 4 two-dimensionally only toward one side.

Figure 3:
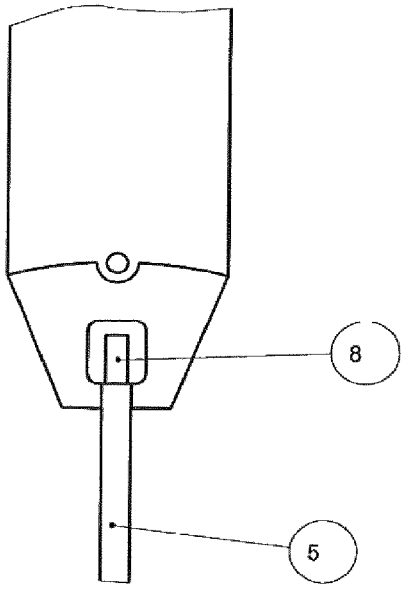

After the adhesive foil has been applied, a solder joint 8 is realized in the area of the contacting point 4 so that a cable 5 is electrically connected to the corresponding portion 4 (FIG. 3).

Next, the liner which is still on the adhesive foil 6 is peeled off.

Figure 4:
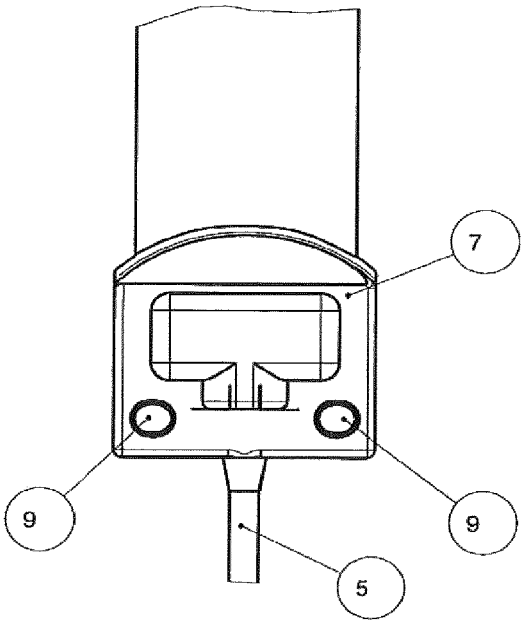

Subsequently, injection overmolding of the connection arrangement is effected by means of the plastic injection overmolding 7, wherein the pressure and temperature input for realizing the plastic injection overmolding simultaneously activates the adhesive foil's adhesive film so that a highly dense and durable bonding is generated. The plastic injection overmolding 7 may further exhibit recesses 9 for attachment (FIG. 4).

The inserted adhesive foil may be, for instance, a foil having a double-sided adhesive, heat-activated adhesive film, with the adhesive agent being already slightly self-adhesive and curing under heat and pressure.

A protective cover, referred to as a liner above, may be made, for example, of a paper layer which is siliconized. Curing temperatures of such an adhesive film, e.g. of the 3M 582 product, are in the range of about 230° C. at a contact pressure of 34 N/cm$^2$ and a curing time of approximately 2 minutes. These values correspond to the processing temperature of the plastic injection compound to be preferably used. Alternatively, acrylate adhesives or else special bonding agents may be used for the adhesive layer with respect to cross-linking of polyimide foil and overmolding layer.

The invention claimed is:

1. An electrical connection arrangement between a flat conductor or conductor portion and a cable, the flat conductor or conductor portion leading to a pane, or laminated pane, and electric or electronic components situated there, and the cable being an integral part of an external connection, wherein the flat conductor or conductor portion is further formed on a carrier film, or polyimide film, and includes an encapsulation as a plastic injection overmolding at least in an area of an electric contacting point of the cable and flat conductor or conductor portion, the electrical connection arrangement comprising:

an adhesion-promoting, heat-activated adhesive film applied in an area of the carrier film while leaving space for the contacting point, yet surrounding or two-dimensionally delimiting same; and the plastic injection overmolding formed on the flat conductor or conductor portion after forming an electrical connection at the contacting point, wherein pressure and temperature input simultaneously activates the adhesive film to realize a highly dense and durable bonding with the plastic injection overmolding.

2. The electrical connection arrangement according to claim 1, wherein the adhesive film is formed as an adhesive foil.

3. The electrical connection arrangement according to claim 2, wherein the adhesive foil exhibits self-adhesive properties.

4. The electrical connection arrangement according to claim 2, wherein the adhesive foil is made of a nonwoven material impregnated and/or coated with an adhesive agent.

5. The electrical connection arrangement according to claim 2, wherein a heat activating and curing temperature of the adhesive film is adapted to a processing temperature of the plastic injection overmolding compound.

6. The electrical connection arrangement according to claim 1, wherein pressure ratios set for forming the overmolding correspond at least to a contact pressure required for the adhesive film.

7. The electrical connection arrangement according to claim 1, wherein due to use of the adhesive film, a secure cross-linking between the carrier film and the overmolding is generated without requiring a pre-casting layer or permanently elastic insulating or sealing compound.

* * * * *